United States Patent [19]

Tapy

[11] Patent Number: 4,720,042

[45] Date of Patent: Jan. 19, 1988

[54] MAILBOX WITH DOOR ACTUATED SIGNAL FLAG

[76] Inventor: Wilbur F. Tapy, 3013 Olive Branch Rd., Greenwood, Ind. 46142

[21] Appl. No.: 33,781

[22] Filed: Apr. 3, 1987

[51] Int. Cl.[4] ..... A47G 29/12

[52] U.S. Cl. ..... 232/35

[58] Field of Search ..... 232/17, 34, 35

[56] References Cited

U.S. PATENT DOCUMENTS

| | | | |
|---|---|---|---|
| 2,668,657 | 2/1954 | Horton | 232/35 |
| 3,144,986 | 8/1964 | Hendrickson . | |
| 3,331,552 | 7/1967 | Shultz . | |
| 3,338,511 | 8/1967 | Cvar . | |
| 3,586,235 | 6/1971 | Fishel | 232/35 |
| 3,589,329 | 6/1971 | Schub . | |
| 3,602,424 | 8/1971 | Raulston . | |
| 3,623,655 | 11/1971 | Tieszen | 232/35 |
| 3,889,874 | 6/1975 | Arwood . | |
| 3,958,752 | 5/1976 | Pieszchala . | |
| 4,005,816 | 2/1977 | Malik . | |
| 4,150,780 | 4/1979 | Mapes . | |

*Primary Examiner*—Robert W. Gibson, Jr.
*Attorney, Agent, or Firm*—Woodard, Emhardt, Naughton Moriarty & McNett

[57] ABSTRACT

A mailbox open at one end with a door sized and configured for closing the open end hingedly attached at its lower edge to the lower edge of the open end. An elongate signal arm is pivotally attached at its lower end to one side of the mailbox to permit frictionless pivotal movement of the signal arm in a plane parallel to the one side of the mailbox. A pivot stop pin is attached to the one side of the mailbox to engage and stop the signal arm at first and second orientations, in the first of which the signal arm is reclined away from the open end of the mailbox, and in the second of which the signal arm is oriented upwardly and disposed in an over-center condition with respect to the pivot. A chain is connected at one end to the signal arm at a location away from the pivot and connected at the other end to the door at a location away from the hinge, the connection locations and length of the chain being such that the signal arm can be reclined in the first orientation when the door is closed, and such that the signal arm is drawn from the first orientation to the second orientation as the door is opened. The length of the chain is sufficient to permit the door to be rotated about its hinge from the closed position to a fully opened position in which the door hangs vertically below the hinge.

6 Claims, 5 Drawing Figures

MAILBOX WITH DOOR ACTUATED SIGNAL FLAG

BACKGROUND OF THE INVENTION

The present invention relates generally to rural mailboxes and more particularly to a mailbox having means for automatically actuating a signal flag attached to the mailbox in response to the opening of the mailbox door.

Rural postal customers are typically required to provide a mailbox situated next to the road so that the postal carrier can deposit the customer's mail into the box without leaving his vehicle. Since the road is often a fair distance from the customer's dwelling, it can be quite inconvenient (and uncomfortable in case of inclement weather) to make repeated trips to the mailbox to see if the day's mail has arrived. In those cases where the mailbox must be located on the other side of the road from the customer's dwelling to accommodate the mailman's route, the result can be unnecessary danger to the customer from passing vehicles if he must repeatedly cross the road to check the mailbox. Consequently, various mailbox constructions have been proposed which provide a visual signalling device attached to the mailbox which is actuated automatically when the mailman opens the mailbox door. The signalling device is usually a flag movable between a horizontal and a vertical orientation. So long as the mailbox is visible from the customer's dwelling, the orientation of the flag indicates to the customer whether the mailman has yet deposited any mail in the box, thereby preventing unnecessary trips to the mailbox. The present invention provides a mailbox having an improved arrangement for actuating the signal flag when the mailman opens the mailbox door.

SUMMARY OF THE INVENTION

The present invention involves a mailbox, including a hollow box open at one end and a door sized and configured for closing the open end of the hollow box. Hinge means hingedly attach the lower edge of the door to the lower edge of the open end of the hollow box. An elongate signal arm is provided. Pivot means pivotally attach the lower end of the signal arm to one side of the hollow box to permit frictionless pivotal movement of the signal arm in a plane parallel to the one side of the hollow box. A pivot stop pin is attached to the one side of the hollow box so as to engage and stop the signal arm at a first orientation in which the signal arm is reclined away from the open end of the hollow box, and to engage and stop the signal arm at a second orientation in which the signal arm is oriented upwardly and disposed in an over-center condition with respect to the pivot means. A chain is connected at one end to the signal arm at a location away from the pivot means and connected at the other end to the door at a location away from the hinged connection. The connection locations and length of the chain are such that the signal arm can be reclined in the first orientation when the door is closed, and such that the signal arm is drawn from the first orientation to the second orientation as the door is opened. The length of the chain is sufficient to permit the door to be rotated about its hinge from the closed position to a fully opened position in which the door hangs vertically below the hinge means.

It is an object of the present invention to provide an improved mailbox having means for automatically raising a signal arm when the mailbox door is opened.

Further objects and advantage will be apparent from the following descriptions.

DESCRIPTION OF THE PREFERRED EMBODIMENT

Figure 1:
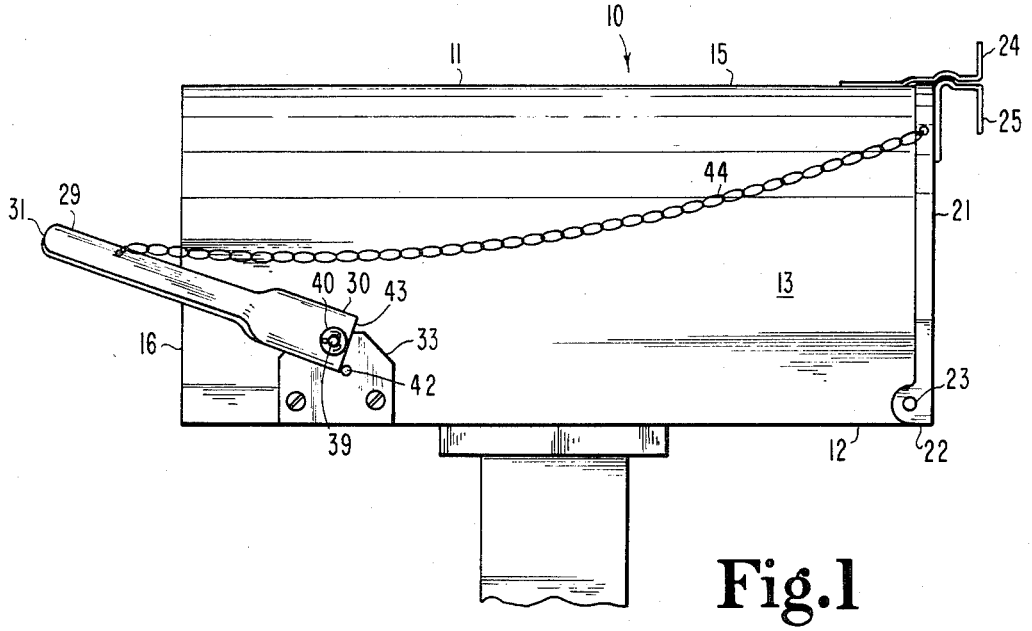
FIG. 1 is a side elevational view of a mailbox constructed in accordance with the present invention in which the signal arm is shown in its first orientation.

For the purposes of promoting an understanding of the present invention, reference will now be made to the embodiment illustrated in the drawings and specific language will be used to describe the same. It is nevertheless to be understood that no limitation of the scope of the invention is thereby intended, the proper scope of the invention being indicated by the claims appended below and the equivalents thereof.

Figure 2:
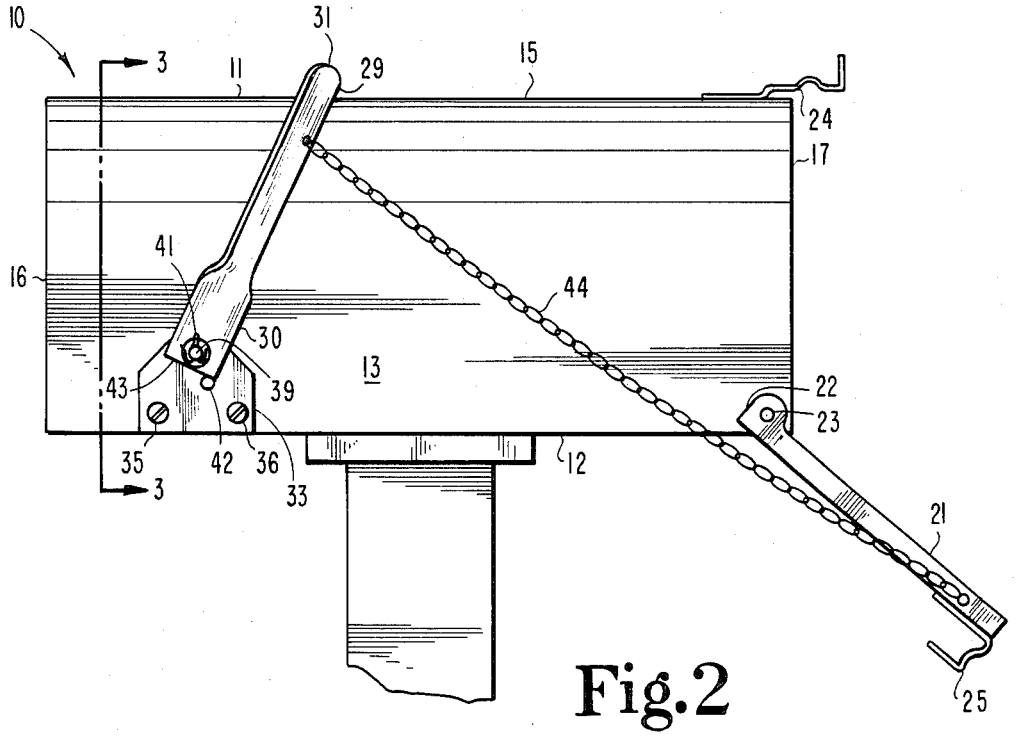
FIG. 2 is a side elevational view of the mailbox of FIG. 1 in which the signal arm is shown in its second orientation.
Figure 3:
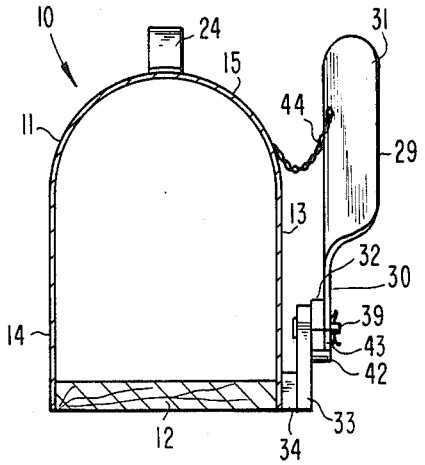
FIG. 3 is a sectional view of the mailbox of FIG. 2 taken along line 3—3.

Referring to FIGS. 1–3, there is illustrated a mailbox 10 constructed in accordance with the present invention. Mailbox 10 includes a hollow box 11 having a bottom wall 12, opposite side walls 13 and 14, a top wall 15, and one end wall 16. Side walls 13 and 14 and top wall 15 are formed from a signal piece of curved metal, resulting in a vault topped box. End 17 of hollow box 11, located opposite end wall 16, is open, providing access to the interior for deposit and removal of mail. A door 21 is hingedly attahced at its lower edge 22 to the lower edge of open end 17 of hollow box 11 by a rivet 23 passing through door 21 and side wall 13. A similar rivet attaches the other side of door 21 to side wall 14. Door 21 is sized and configured to close open end 17, and is held in the closed orientation by spring catch 24 attached to top wall 15, which engages pull handle 25 attached to door 21 near the upper edge thereof.

Pivotally attached to side wall 13 is an elongate signal arm 29 having a lower end 30 which is of planar configuration and oriented parallel to side wall 13. From lower end 30 to upper end 31, signal arm 29 is twisted about its longitudinal axis such that the upper end 31 is of planar configuration and oriented at an acute angle with respect to side wall 13. The configuration of signal arm 31 is best depicted in FIG. 3. Affixed to lower end 30 is reinforcement block 32.

Means for pivotally attaching signal arm 29 to side wall 13 includes bracket 33 which is mounted in spaced relationship to side wall 13 via spacer block 34 and screws 35 and 36. Received through an aperture in bracket 33 is pivot pin 39, which also passes through an aperture in reinforcement block 32 and lower end 30 of signal arm 29, which latter aperture is sized to permit substantially frictionless pivotal movement of signal arm 29 with respect to pivot pin 39. Washer 40 and cotter pin 41 prevent axial displacement of signal arm 29 with respect to pivot pin 39.

A pivot stop pin 42 is received through an aperture in bracket 33 and extends outwardly sufficiently to engage the lower edge 43 of signal arm 49 in either of two orientations. In the first orientation, shown in FIG. 1, signal arm 29 is reclined away from the open end 17 of hollow box 11, and pivot stop pin 42 engages lower edge 43 to stop signal arm 29 and prevent further counterclockwise pivotal motion about pivot pin 39. In the second orientation, shown in FIG. 2, signal arm 29 is oriented upwardly, and pivot stop pin 42 engages lower edge 43 to stop signal arm 29 and prevent further clockwise pivotal motion about pivot pin 39. The second orientation is characterized by signal arm 29 being in an "over center" condition, meaning that the combined effect of gravity acting on signal arm 29 and the pulling force exerted by the chain 44 (described fruther below) are such as to cause signal arm 29 to tend to pivot clockwise about pivot pin 39, which motion is opposed by pivot stop pin 42, thereby resulting in a condition of stability.

Chain 44 connects signal arm 29 to door 21 such that as door 21 is opened, signal arm 29 is drawn upwardly from its first orientation to its second orientation, where it remains until it is manually lowered into the first orientation again. As a consequence of this arrangement, signal arm 29 is automatically actuated by the mailman when he opens the mailbox door to deposit mail therein, providing a visible signal to the customer that the day's mail has arrived. The length of the chain and its attachment locations at the signal arm and door are chosen so that there is sufficient length to permit signal arm 29 to repose in the first orientation when door 21 is closed, yet cause signal arm 29 to be drawn into the over-center condition of the second orientation as door 21 is opened. It is further desirable that chain 44 be of sufficient length that door 21 can be rotated about its hinged attachment 23 from its closed position to a fully opened position in which door 21 hangs vertically below hinge 23 when signal arm 29 is in the second orientation. This allows the door to fall all the way downward in the event the mailman forgets to close door 21. If chain 44 were not arranged to permit this, door 21 might be supported in a horizontal orientation, presenting a hazard to passing vehicles.

Because the pivot means by which signal arm 29 is attached to side wall 13 is substantially frictionless, it is not necessary for chain 44 to be pulled taught to draw signal arm 29 into its over-center condition, as the weight of chain 44 in opposition to the weight of signal arm 29 will aid in drawing signal arm 29 over-center as door 21 is opened. The configuration of signal arm 29 is such that its center of gravity is to the right of its longitudinal axis, as viewed in FIGS. 1 and 2. This configuration also aids signal arm 29 in falling "over-center" without chain 44 having to be drawn taught. Consequently, chain 44 can be made long enough that it does not impede door 29 from falling all the way downward out of the way of passing vehicles.

Figure 4A:
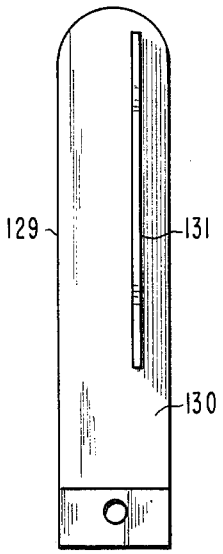
FIG. 4*a* is an elevational view of an alternative embodiment of the signal arm of the mailbox of FIGS. 1–3.
Figure 4B:
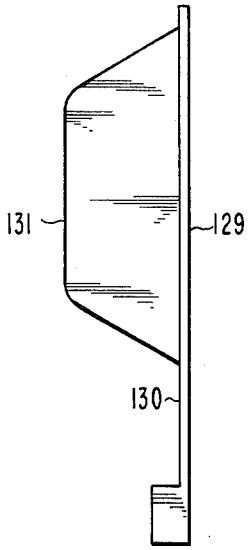
FIG. 4*b* is a right side view of the signal arm of FIG. 4*a*.

Referring to FIGS. 4*a* and 4*b*, there is illustrated an alternative signal arm 129, which can be substituted for the signal arm 29 shown in FIGS. 1–3. Unlike signal arm 29 which is constructed of a single piece of twisted planar material, signal arm 129 includes a first planar piece 130 and a second planar piece 131 oriented perpendicularly thereto.

While the preferred embodiment of the invention has been illustrated and described in some detail in the drawings and foregoing description, it is to be understood that this description is made only by way of example to set forth the best mode contemplated of carrying out the invention and not as a limitation to the scope of the invention which is pointed out in the claims below.

What is claimed is:

1. A mailbox, comprising:

a hollow box open at one end;

a door sized and configured for closing the open end of said hollow box;

hinge means for hingedly attaching the lower edge of said door to the lower edge of the open end of said hollow box;

an elongate signal arm;

pivot means for pivotally attaching the lower end of said signal arm to one side of the hollow box to permit frictionless pivotal movement of said signal arm in a plane parallel to the one side of the hollow box;

a pivot stop pin attached to the one side of the hollow box so as to engage and stop said signal arm at a first orientation in which said signal arm is reclined away from the open end of the hollow box, and to engage and stop said signal arm at a second orientation in which said signal arm is oriented upwardly and disposed in an over-center condition with respect to said pivot means; and a chain connected at one end to said signal arm at a location away from said pivot means and connected at the other end to said door at a location away from the hinged connection, the connection locations and length of said chain being such that said signal arm can be reclined in the first orientation when said door is closed, and such that said signal arm is drawn from the first orientation to the second orientation as said door is opened, the length of said chain further being sufficient to permit said door to be rotated about its hinge from the closed position to a fully opened position in which the door hangs vertically below the hinge means.

2. The mailbox of claim 1, in which said pivot means includes a bracket mounted to one side of the hollow box, which bracket supports a pivot pin orientated perpendicular to the one side of the hollow box, and in which said elongate signal arm defines a pivot aperture through the lower end thereof sized to receive the pivot pin with sufficient clearance to permit substantially frictionless pivotal movement therebetween.

3. The mailbox of claim 2, in which said pivot stop pin is disposed with respect to said pivot pin so as to engage said signal arm at a lcoation below said pivot pin.

4. The mailbox of claim 3, in which said signal arm has a planar lower portion oriented parallel to the one side of the hollow box, and a planar upper portion oriented at an acute angle with respect to the one side of the hollow box.

5. The mailbox of claim 2, in which said signal arm has a lower edge located below the pivot aperture of said signal arm oriented perpendicular to the longitudinal axis of said signal arm, said pivot stop pin alternately engaging said lower edge at two different locations each corresponding to one of said first and said second orientations of said signal arm.

6. The mailbox of claim 5, in which said bracket is configured to mount said signal arm in spaced relationship with respect to the one side of the hollow box.

* * * * *